US010591232B2

(12) United States Patent
Polovnev et al.

(10) Patent No.: US 10,591,232 B2
(45) Date of Patent: Mar. 17, 2020

(54) RECOILLESS UNDERWATER FIREARM

(71) Applicants: Andrey Albertovich Polovnev, Moscow (RU); Liliyana Borisovna Polovnev, Moscow (RU)

(72) Inventors: Andrey Albertovich Polovnev, Moscow (RU); Liliyana Borisovna Polovnev, Moscow (RU)

( * ) Notice: Subject to any disclaimer, the term of this patent is extended or adjusted under 35 U.S.C. 154(b) by 0 days.

(21) Appl. No.: 16/085,564

(22) PCT Filed: Mar. 13, 2017

(86) PCT No.: PCT/RU2017/000130
§ 371 (c)(1),
(2) Date: Sep. 14, 2018

(87) PCT Pub. No.: WO2017/160185
PCT Pub. Date: Sep. 21, 2017

(65) Prior Publication Data

US 2019/0101344 A1 Apr. 4, 2019

(30) Foreign Application Priority Data

Mar. 14, 2016 (RU) ..... 2016108978

(51) Int. Cl.
*F41A 1/08* (2006.01)
*F41C 9/06* (2006.01)
*F42B 30/00* (2006.01)

(52) U.S. Cl.
CPC ..... *F41A 1/08* (2013.01); *F41C 9/06* (2013.01); *F42B 30/00* (2013.01)

(58) Field of Classification Search
CPC ..... F42B 30/00; F41A 1/08
(Continued)

(56) References Cited

U.S. PATENT DOCUMENTS 1,108,714 A 8/1914 Davis
3,274,936 A * 9/1966 Messina ..... F41C 9/06 102/371

(Continued)

FOREIGN PATENT DOCUMENTS

RU 2149093 C1 12/1999
RU 2390701 C2 5/2010

OTHER PUBLICATIONS

International Search Report and Written Opinion; dated Sep. 14, 2017; 5 pages.

*Primary Examiner* — John Cooper
(74) *Attorney, Agent, or Firm* — Nexsen Pruet, LLC; John B. Hardaway, III; Todd A. Serbin

(57) ABSTRACT

The invention relates to recoilless firearms, the gun carriage of which has zero recoil during a shot. The recoilless firearm comprising a gun carriage, a fire control tool, and a barrel, which contains at least a breechblock, a primer-igniter, a propellant charge and a projectile, wherein the barrel is connected to the gun carriage with the possibility of movement in the gun carriage during a shot under the impact of the propellant gas on the breechblock. The barrel is provided with a possibility of disconnecting from the gun carriage before the shot. The fire control tool is connected to the barrel and provides the barrel displacing in the gun carriage for carrying out the shot, and the breechblock is equipped with a firing mechanism, which acts on the primer-igniter when the barrel is displaced in the gun carriage. The invention provides safety of a shot via the guaranteed elimination of recoil during a shot, and also increases the efficacy of neutralizing large targets due to the applicability of high-impulse ammunition when shooting under the water, shooting from the air into the water, shooting in the air and also in weightlessness in the open space.

12 Claims, 2 Drawing Sheets

(58) Field of Classification Search
USPC ..... 89/1.7; 42/1.14
See application file for complete search history.

(56) References Cited

U.S. PATENT DOCUMENTS

| | | | | | |
|---|---|---|---|---|---|
| 3,300,888 | A * | 1/1967 | Belcher | A01K 81/00 | 42/1.14 |
| 3,580,172 | A * | 5/1971 | Hendricks | A01K 81/04 | 102/371 |
| 3,729,853 | A * | 5/1973 | Critcher | F41C 3/14 | 42/65 |
| 4,266,358 | A * | 5/1981 | Phillips | F41A 9/38 | 42/1.14 |
| 4,848,209 | A * | 7/1989 | Almeras | B25C 1/143 | 89/1.14 |
| 7,814,696 | B2 | 10/2010 | Rapp et al. | | |
| 2014/0013639 | A1 * | 1/2014 | Polovnev | F41C 9/06 | 42/1.14 |

* cited by examiner

RECOILLESS UNDERWATER FIREARM

TECHNICAL FIELD

The invention relates to recoilless firearms, the gun carriage of which has zero recoil during a shot.

PRIOR ART

The need to create such recoilless underwater firearm is stipulated by the fact that existing restrictions for the allowed energy of recoil at a shot for the shooters (swimmers) who are in the water and for small-sized underwater vehicles, does not allow using a high-impulse ammunition in their firearms, which can provide effective shooting at large underwater objects, including, sharks, whales, tunas, etc.

The device for underwater firing from a firearm is known (see Description to Patent RU 2498189 C2 of 10 Nov. 2013; the U.S. Pat. No. 8,919,020 B2 of 30 Dec. 2014 and European Patent Specification No 2690390 B1 of 10 Aug. 2016), which allows using any firearm and ammunition of any caliber with an underwater projectile—a cavitating core (see Description to Patents RU 2268455 C1 of 20 Jan. 2006 or RU 2316718 C1 of 10 Feb. 2008; the U.S. Pat. No. 8,082,851 B2 of 27 Dec. 2011; European Patent Specification No. 2 053 342 B1 of 18 Jun. 2014).

However, this device for underwater firing reduces the recoil momentum only by 20-30% when using a muzzle brake that limits the power of ammunition, which can be used in firearm of swimmers and small-sized underwater vehicles. For example, the shotgun ammunition of 12th gauge with an underwater projectile weight of 30 g, gunpowder weight of 2.3 g and projectile muzzle velocity of 440 m/s has the recoil momentum of 1.6 kg×s, which is quite acceptable in hand-held underwater firearm. The 12.7 mm ammunition with an underwater projectile weight of 60 g, the gunpowder weight of 15.5 g and projectile muzzle velocity of 750 m/s has the recoil momentum of 6.5 kg×s, which can turn the swimmer around when shooting in the water and is not desirable in hand-held underwater firearm.

A firearm for small-sized unmanned underwater vehicles (UUV) is known (see Description to the U.S. Pat. No. 7,814,696 B2, Int. Cl.[7] F41A 19/58, published on 19 Oct. 2010). In this firearm the barrel is open on both sides and is fastened to the gun carriage; two propellant charges are placed in the middle of the barrel, they are divided by means of a transverse wall and contain two primer-igniters connected with a fire control tool. One propellant charge is closed by an underwater projectile and the other propellant charge is closed by an inert projectile. At a shot the underwater projectile flies out of the barrel towards the target and the inert projectile flies out of the barrel into the opposite side; that partially reduces the recoil on the gun carriage of the firearm.

To completely eliminate the recoil, it is necessary that both projectiles leave the barrel simultaneously and have the same recoil momentum, which depends on the projectile weight, on the projectile muzzle velocity, on the propellant charge weight, and it is also necessary that the impulse of the water outflow from the barrel to both sides and the impulse of the gas outflow from two propellant charges be the same. It is difficult to implement this condition in real firearms due to tolerance for the time of propellant charges ignition, tolerances for the parameters and weight of propellant charges and projectiles.

Therefore, in one embodiment of this firearm one propellant charge is used, which is closed by the underwater projectile from one side, and is closed by the inert projectile from the other side. This embodiment of firearm corresponds to the design of recoilless firearm with an inert projectile that was used in guns for firing from airplanes at the beginning of the last century (see Descriptions to the U.S. Pat. Nos. 1,108,715; 1,108,716 and 1,108,717 published on 25 Aug. 1914 and U.S. Pat. No. 1,395,630 published on 11 Nov. 1921).

However, recoilless firearm with an inert projectile requires an increase of the propellant charge weight, an increase in the length and weight of the barrel for accelerating the inert projectile, as well as a heavy inert projectile for obtaining the velocity of the active projectile, which could be obtained in classic firearm. Besides, it is possible to completely eliminate the recoil, provided that the active and inert projectiles will leave the barrel at the same time, but it is difficult to realize in real firearm because of the tolerances for barrels and projectiles sizes and the tolerances for the projectiles weight.

Moreover, at underwater shot the inert projectile, the water, and the propellant gas exhausting from the barrel into the opposite side of the shot create a hydraulic shock, the impact of which on the gun carriage and on the weapon carrier is much greater than the recoil from a shot of a classic firearm.

It should be noted that the hydraulic impact from the stream of propellant gas exhausting from the barrel into the opposite side of the shot does not allow using the known principle of recoilless dynamo-reactive weapon in underwater armament of swimmers and small-sized underwater vehicles.

A firearm for small-sized underwater unmanned vehicles (UUV) is known (see Description to the U.S. Pat. No. 7,984,581 B2, Int. Cl.[7] F41A 19/58, published on 26 Jul. 2011). This firearm includes a barrel closed by breechblock and installed inside the hydraulic cylinder, which is open from the side of the breechblock, is rigidly fastened to the gun carriage and is filled with water from the external environment. A projectile, a propellant charge, and a primer-igniter, connected with the fire control tool, are placed in the breech end of the barrel.

In one embodiment of this firearm, the barrel is movably attached to the hydraulic cylinder with a spring placed inside. At a shot, the barrel moves into the rear side, compresses the spring and pushes out the water from the hydraulic cylinder into the opposite side of the shot; that partially reduces the recoil.

In another embodiment of this firearm, the barrel has gas vents and is rigidly fastened to the hydraulic cylinder, with a gas piston located inside. At a shot, part of the propellant gas exhausts from the barrel through gas vents and pushes the gas piston, which pushes out the water from the hydraulic cylinder into the opposite side of the shot; that partially reduces the recoil.

The next embodiment of this firearm differs from the previous embodiment by the presence of a spring that is located in the hydraulic cylinder, reduces the speed of the gas piston movement during the shot and the speed of the water pushed out from the hydraulic cylinder; and after the shot the spring returns the gas piston to its original position.

The listed embodiments of this firearm cannot completely eliminate the recoil of the shot, which acts on the gun carriage.

The closest analog (prototype) of this claimed invention is a recoilless firearm (see Description to the U.S. Pat. No. 1,108,714 published on 25 Aug. 1914). This firearm includes a barrel closed by breechblock and not rigidly fixed in the gun carriage, which is made in the form of a tube open on both sides. The breech end of the barrel contains a projectile with a propellant charge, an electric primer-igniter connected by an electric wire with a firing control tool and electric batteries. At a shot, the projectile flies out of the barrel towards the target, while the barrel, under the impact of the propellant gas on the breechblock, moves into the opposite side and leaves the tube (gun carriage); this can completely eliminate the recoil of a shot, in the case of free movement of the barrel within the gun carriage (tube).

However, this firearm does not guarantee the complete elimination of recoil during a shot, because the outer surface of the barrel is constantly pressed against the inner surface of the gun carriage by means of a locking screw and does not provide disconnecting of the barrel from the gun carriage before the shot. That is why the recoil in this firearm is unpredictable and depends on the locking force of the locking screw and on the friction force of the barrel movement in the gun carriage. And the gun carriage will also feel the impact of breaking the electric wire connecting the electric primer-igniter with the fire control tool. In this case, the greatest recoil from overcoming the initial locking force of the locking screw has an effect until the projectile flies out of the barrel; that can divert the firearm from the point of aiming and reduce the accuracy of the shot.

Moreover, this firearm is not provided for the use of unitary ammunition because the electric primer-igniter, the propellant charge and the projectile are united by the barrel, not by the cartridge case; that makes it difficult to load the barrel before the shot and does not guarantee the specified shot parameters, thus reducing the accuracy and efficiency of the shot.

Perhaps the abovementioned unpredictable recoil during the shot and low accuracy of shooting is acceptable for a flying airplane, but for swimmers and small-sized underwater vehicles that are under the water, as in a state of weightlessness, such unpredictable recoil when shooting from recoilless firearms is unsafe, because even a partial recoil of the shot with a high-impulse ammunition can lead to the loss of their orientation in the water, which excludes the possibility of effective shooting.

SUMMARY OF THE INVENTION

The objective of the given invention is to increase the efficiency and safety of shooting from recoilless firearm at the expense of the guaranteed elimination of recoil acting on the firearm gun carriage.

The achievement of the mentioned objective is provided by a recoilless firearm comprising: a gun carriage, a fire control tool and a barrel, which contains at least a breechblock, a primer-igniter, a propellant charge and a projectile, wherein the barrel is connected to the gun carriage with the possibility of movement in the gun carriage during a shot under the impact of the propellant gas on the breechblock, where, pursuant to this invention, the said barrel is provided with a possibility of disconnecting from the gun carriage before the shot, while the fire control tool is connected to the barrel and provides the barrel displacing in the gun carriage for carrying out the shot, and the breechblock is equipped with a firing mechanism, which acts on the primer-igniter when the barrel is displaced in the gun carriage.

That stated totality of inventive features specified in the independent patent claim allows increasing efficiency and safety of shooting from recoilless firearm by guaranteed elimination of recoil acting on the gun carriage at a shot according to the following differences from the prototype:

the recoilless firearm is provided with a possibility of the barrel disconnecting from the gun carriage before a shot and the fire control tool is connected with the barrel and provides the barrel displacing in the gun carriage for carrying out a shot;

the firing mechanism can act on the primer-igniter only after the barrel displacing in the gun carriage and can carry out a shot after the barrel is disconnected and displaced in the gun carriage thus guaranteeing elimination of recoil acting on the firearm gun carriage.

In the preferred embodiment of this invention, the propellant charge and the projectile are united by a cartridge case, which is equipped with a percussion primer-igniter, and form a unitary ammunition, and the breechblock is equipped with a percussion firing mechanism.

This embodiment increases the efficiency and safety of the invention by means of using unitary ammunition with guaranteed stabile parameters of the shot, equipped with a percussion primer-igniter actuated by a percussion firing mechanism.

In the embodiment of this invention, the propellant charge and the projectile are united by a cartridge case, which is equipped with an electric primer-igniter, and form unitary ammunition, and the breechblock is equipped with an electrical or an electromechanical firing mechanism.

This embodiment increases the efficiency and safety of the invention by means of using unitary ammunition with guaranteed stabile parameters of the shot, equipped with the electric primer-igniter percussion primer-igniter actuated by an electrical or an electromechanical firing mechanism.

In the embodiment of this invention, the barrel is equipped with sealing elements installed in the muzzle of the barrel and in the breech end of the barrel, which prevent the water from penetrating into the barrel until the projectile flies out of the barrel.

This embodiment provides the invention efficiency increase due to the possibility of underwater shot from a dry barrel bore that increases of the projectile muzzle velocity by 30-60% compared to shooting from a wet barrel bore that is filled with the water before the shot.

For example, when firing from a water-filled barrel of caliber 12.7 mm and length of 730 mm, an underwater projectile weighing 60 g has a muzzle velocity of Vo=480 m/s at the maximum shot pressure of Pmax=340 MPa. When firing from this dry barrel, this underwater projectile has the muzzle velocity of Vo=590 m/s at the maximum shot pressure of Pmax=210 MPa, and with an increase in the gunpowder weight to provide the maximum shot pressure of Pmax=340 MPa, the muzzle velocity of this underwater projectile increases to Vo=750 m/s.

In the embodiment of this invention, the barrel is equipped with a float fixed by a cord and intended to detect the barrel after the shot. And it is advisable to equip the float with a luminous or reflective element.

This embodiment of the invention simplifies the detection of the barrel on the bottom after the shot and allows the barrel to be used repeatedly, for example, at underwater hunting and at training shooting that provides the invention efficiency increase, because shooting from the repeatedly tested barrel is always more effective. Moreover, the initial velocity of the barrel after the shot usually does not exceed 30-40 m/s and is commensurable with the velocity of the harpoon fired from the harpoon gun, so the barrel loses velocity at 7-8 m range from the shooter and can be detected on the bottom by means of the float fixed on the cord, which will float 0.5-1 m above the barrel and can be equipped with a luminous or a reflective element.

In some cases, for example, when shooting above deep water, the barrel can dive deeply and be lost. In this case, it is necessary to perceive the barrel as part of the ammunition and to understand that an accurate shot with high-impulse ammunition is more important than multiple shots with small-impulse ammunition, which in principle cannot provide destroying of a chosen large underwater target. Moreover, the price of the chosen large target can repeatedly exceed manifold the price of the lost barrel.

In the embodiment of this invention, the barrel is equipped with an inflatable float, which provides lifting of the barrel to the water surface after the shot. In this case, it is advisable to equip the float with a luminous and/or reflective element, and also to equip it with a radio beacon.

This embodiment provides the invention efficiency increase due to the eliminating the loss of the barrel after the shot and the possibility of repeated use of the barrel, because shooting from the repeatedly tested barrel is always more effective. In this case, the float can be made in the form of an inflatable ball. For example, for lifting barrel weighing 1 kg to the water surface, the volume of the inflatable ball should be 1 litr (100 $cm^3$)

BRIEF DESCRIPTIONS OF THE DRAWINGS

The invention is explained in more detail with the reference to specific embodiments that in no way reduce the volume of claims and are only intended for better understanding of the invention by one of skill in the art.

In the description of specific embodiments of the invention there are references to the accompanying drawings that show the following:

DESCRIPTION OF THE PREFERRED EMBODIMENT

Figure 1:
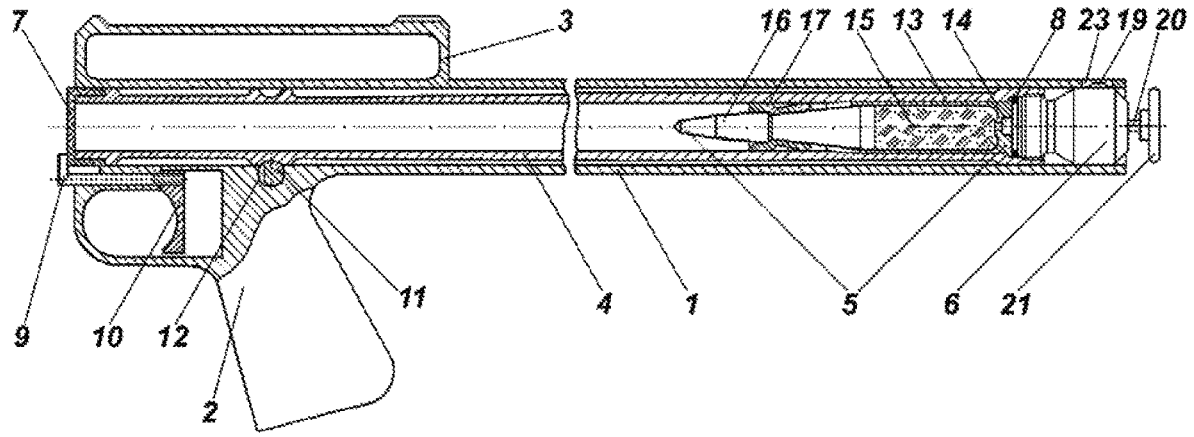
FIG. 1 shows the first example of the invention embodiment before a shot.

FIG. 1 shows the longitudinal cross-section of a recoilless underwater hunting firearm of the 12th gauge before a shot. The firearm includes: a gun carriage 1 executed in the form of an open on both sides tube with a pistol grip 2 and a carrying handle 3, which comprises a front sight and a rear sight, a barrel 4 with an ammunition 5, which is closed by a screwing breechblock 6 with a firing mechanism, a sealing plastic cap 7 and a sealing rubber ring 8, which prevents water penetrating into the barrel until a shot.

Fire control tool has a manual drive providing movement of the barrel 4 in the gun carriage 1 for carrying out the shot and contains a trigger bar 9, which is connected with a trigger 10 and with the edge of the muzzle face of the barrel 4, which is closed by a plastic sealing cap 7. The barrel 4 is kept from moving in the gun carriage 1 by a safety-lock 11 with a segmented slot 12, which can be turned around its longitudinal axis by means of an external lever of the safety-lock 11 (an external lever is not shown).

The barrel 4 and the screwing breechblock 6 are made of steel 40 KHN with tensile strength of 980 MPa. Internal diameter of a smooth barrel bore is equal to 18.5 mm, the barrel length is 730 mm, the total weight of the barrel 4 with the lock 6 is 1.1 kg, wherein the geometry of the external surface of the barrel 4 is executed according to the chart of pressure of the shot for maximum pressure Pmax=300 MPa.

The ammunition 5 contains a brass cartridge case 13 for a sporting-hunting gun of the 12th gauge, a primer-igniter 14, a propellant charge (gunpowder) 15 and an underwater projectile weighing 74 g, which includes a brass cavitating core 16 weighing 70 g and an aluminum discarding sabot 17 weighing 4 g. The design of the underwater projectile is executed according to Patent RU 2268455 C1 of 20 Jan. 2006 or Patent RU 2316718 C1 of 10 Feb. 2008; U.S. Pat. No. 8,082,851 B2 of 27 Dec. 2011 and European Patent Specification No. 2053342 B1, of 18 Jun. 2014.

The largest diameter (caliber) of the cavitating core 16 is equal to 18.5 mm, its length is 92 mm, the nose surface is made in the form of a cone with an angle at the apex of 120 degrees and the diameter of the cavitating edge is 3.2 mm. In the aluminum sabot 17 there are two internal longitudinal grooves, which ensure its separation into two sectors when the projectile enters into the water. If the cartridge case 13 is equipped with a percussion primer-igniter 14, a percussion firing mechanism is used.

Figure 2:
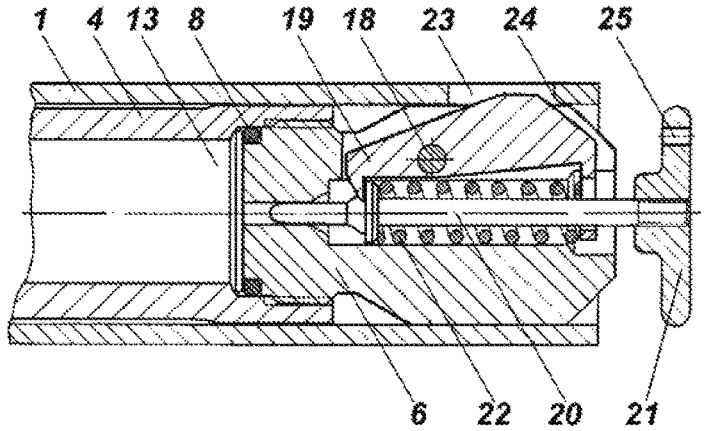
FIG. 2 shows the example of embodiment of the breechblock with the percussion firing mechanism before a shot.

FIG. 2 shows a longitudinal cross-section of the breechblock of the firearm with a percussion firing mechanism before a shot. The screwing breechblock 6 is fastened to the barrel 4 by the thread M25×2 and presses the head of the cartridge case 13 with a percussion primer-igniter to the rear cone of the cartridge chamber of the barrel 4, and also compresses the sealing rubber ring 8, which prevents penetration of the water from the breech side into the barrel bore.

The breechblock 6 has a central opening and a narrow radial groove 23, in which the firing mechanism is mounted, which contains a sear 19 fixed on the sear pin 18, a firing pin 20, a pin handle 21 and a mainspring 22. The sear 19 is made in the form of a two-shoulder lever, and different length of the shoulders makes it possible to reliably hold the firing pin 20 with the firing pin handle 21 and the compressed mainspring 22 before the shot by means of the own force of the mainspring 22, and additional action on the sear 19 is required to release the firing pin 20.

In the rear of the tube of the gun carriage 1 a narrow longitudinal groove 23 is executed, in which the ledge of the sear 19 is located; at same time the rear wall 24 of the radial groove 23 has an inner rounding-off, which is intended for acting on the sear 19 and its rotation for carrying out a shot. An opening 25 may be made in the pin handle 21 for a possibility of fastening a float by means of a cord (float and cord are not shown).

The loading of the barrel 4 should be carried out in the open air, for this purpose a sealing plastic cap 7 is screwed on the muzzle of the barrel 4, the ammunition 5 is installed into the cartridge chamber of the barrel 4 and the screwing breechblock 6 is closed with a sealing rubber ring 8 and the firing mechanism should not be cocked.

The firearms loading may be carried out in the water or in the open air, for this purpose the barrel 4 is installed in the gun carriage 1 from the breech side to the stop in the ledge of the trigger bar 9 and fixed by means of a safety-lock 11, which is turned with the segmented slot 12 upwards during the installation of the barrel 4 into the gun carriage 1 and with the segmented slot 12 to the right or to the left after the installation of the barrel 4, at the same time the ledge of the sear 19 should be located in the radial groove 23.

The firing mechanism should be cocked before a shot, for this purpose the pin handle 21 with the firing pin 20 should be pulled to the back side and the mainspring 22 squeezed, while the sear 19 rotates on the sear pin 18 and holds the firing pin 20 in the rear position, as shown on FIG. 2.

Before a shot, the firearm is held by means of a pistol grip 2, and the tube of the gun carriage 1 should be put on the shooter's shoulder, according to the well-known principle of holding a hand-held recoilless dynamo-reactive grenade launcher.

In this firearm design the shot is not possible without preliminary disconnecting of the barrel 4 from the gun carriage 1 by means of turning the safety-lock 11 and adjustment of the segmented slot 12 with the barrel 4, because carrying out of a shot requires initial displacing of the barrel 4 by means of a firing control tool.

Therefore, before a shot, it is necessary to turn the safety-lock 11 with the segmented slot 12 upwards for disconnecting the barrel 4 from the gun carriage 1. In this case, the ledge of the trigger bar 9 and the ledge of the sear 19 located in the radial groove 23 will keep the barrel 4 from premature movement and falling out of the gun carriage 1. Moreover, the force of turning the sear 19 withheld by the compressed mainspring 22 is more than the total weight of the barrel 4 with the breechblock 6 and the ammunition 5, and rigidity of the mainspring 22 is agreed with their weight.

Aiming of the firearm at a target is made by means of the front sight and rear sight, which are located on the carrying handle 3. Moreover, the firearm can be supplied with a laser sight the beam of which is well visible in transparent water at a range of more than 20 m.

For carrying out a shot it is necessary to press the trigger 10, at the same time the trigger bar 9 will move the barrel 4 to the rear side, and the ledge of the sear 19 at interaction with the rear wall 24 of the radial groove 23 will turn the sear 19 around the sear pin 18 and will release the cocked firing pin 20 with the pin handle 21, which, under the influence of the compressed mainspring 22, will move forward and the firing pin 20 will be acting on the percussion primer-igniter established in the cartridge case 13. At the same time the sear 19 will leave the radial groove 23 and will cease to hold the barrel 4 from a possibility of free movement to the rear side.

When the propellant charge (gunpowder) 15 burns, the propellant gas accelerates the underwater projectile (a cavitating core 16 with a discarding sabot 17) in the barrel 4 towards the target; and the barrel 4 due to the action of the powder gas on the bottom of the cartridge case 13 and the breechblock 6 will freely move within the gun carriage 1 in the opposite direction, without making any impact on the gun carriage 1. The propellant charge 15 weighing 11.6 g and produced of sporting/hunting gunpowder of the type "Norma 203-B" or "VihtaVuory N140" at the maximum pressure of Pmax=200 MPa and the muzzle pressure of P=40 MPa provides the projectile muzzle velocity of Vo=640 m/s against the barrel 4. However, at the moment when the underwater projectile weighing 74 g exits from the barrel 4, this barrel with the breechblock 6 and the cartridge case 13 having a total weight of 1120 g will move in the gun carriage 1 on 0.05 m back with the velocity of 40 m/s, that will reduce the muzzle velocity of the underwater projectile by 40 m/s. Therefore the projectile will have the muzzle velocity of 600 m/s relative to the motionless gun carriage 1. The recoil momentum of a shot with such ammunition is equal to 6.2 kg×s, but the shooter will not feel this recoil as the barrel 4 does not have any impact on the gun carriage 1.

The barrel 4 with the breechblock 6 and the cartridge case 13 will be braked by the water even before exiting from the gun carriage 1 and completely lose its velocity at 6-8 m range from the shooter and sink to the bottom. If the barrel is equipped with a float fixed on a cord, for example, in an opening 25 of a pin handle 21, then it will simplify detection of the barrel on the bottom by means of this float, which will float above the barrel, and this float can be equipped with a luminous element. If the barrel 4 is equipped with a float providing lifting of the barrel to the water surface, the barrel will float near the water surface, and the float—on the water surface.

A part of the powder gas will overtake the projectile in the barrel and rupture the sealing plastic cap 7 before the nose of the cavitating core 16 approaches the muzzle of the barrel. At the projectile exit from the barrel, the sabot 17 will separate in the water from the cavitating core 16, which, having the parameters stated above, will begin the movement in the water in the formed cavity with the muzzle velocity of 600 m/s and energy of 12,600 Joules, and the velocity of the cavitating core 16 will be 500 m/s and energy 8,700 Joules at the 5 m underwater range; velocity will be 420 m/s and energy of 6,100 Joules at 10 m water range; velocity will be 350 m/s and energy 4,200 Joules at the 15 m underwater range. These parameters of velocity, energy, weight and dimensions of the cavitating core 16 can provide destroying of a large underwater object, including a shark or a tuna weighing 500-700 kg. For example, the known hunting bullet of 12th gauge "Brenneke" for shotgun ammunition 12/70 Magnum, which is widely used for hunting for large land animals has the diameter of 18.5 mm, the weight of 31.5 g, muzzle velocity of 460 m/s and energy of 3,335 Joules, and at the 50 m air range this bullet has the velocity of 352 m/s and energy of 1,951 Joules. For example, see: http://www.brenneke-ammunition.de/en/shotgun-ammunition/classic To increase the safety of using high-impulse ammunition 5 with the increased parameters of the shot and exception of a possibility of their use in the existing hunting guns of the 12th gauge, which are checked at the maximum pressure of Pmax=85 MPa or Pmax=120 MPa, it is expedient to equip the cartridge case 13 with an electric primer-igniter 14 and to use the electrical or electromechanical firing mechanism in the presented recoilless firearm.

Figure 3:
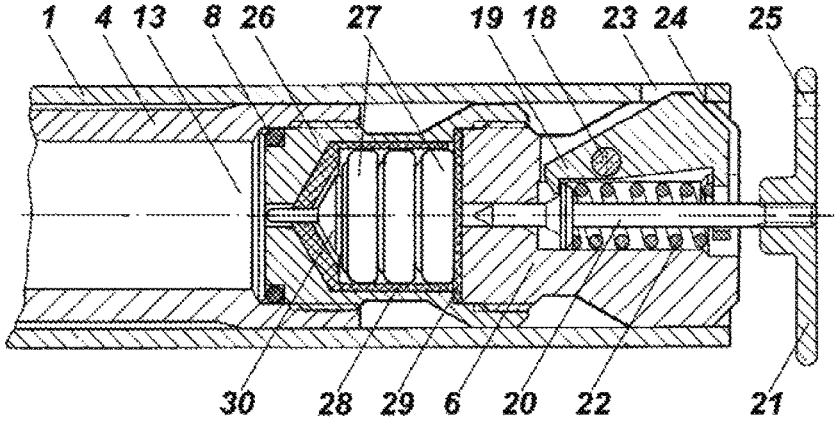
FIG. 3 shows the example of embodiment of the breechblock with the electromechanical firing mechanism before a shot.

FIG. 3 shows a longitudinal cross-section of the breechblock of the firearm with the electromechanical firing mechanism before a shot. An electric-lock 26 is fastened to the barrel 4 by the thread M25×2 and presses the head of the cartridge case 13 with an electric primer-igniter to a rear cone of the cartridge chamber of the barrel 4, and also compresses the sealing rubber ring 8, which prevents the penetration of the water from the breech side into the barrel, also prevents the penetration of the water from the side of the cartridge case 13 into the casing of the electric-lock 26, where an electric battery 27 is placed, which is isolated by a plastic case 28 and a sealing rubber disk 29.

An electro-contact 30 is in contact with a forward part of the battery 27 and also is in contact with the electric primer-igniter installed in the cartridge case 13. The screwing breechblock 6 is fastened to the electric-lock 26 by the thread M25×2 and presses the sealing rubber disk 29, which prevents the penetration of the water from the screwing lock 6 into the casing of the electro-lock 26. The screwing breechblock 6 is supplied with a percussion firing mechanism, the design and work of which corresponds to the firing mechanism presented on FIG. 2, but which can have a reduced length, as the electromechanical firing mechanism does not require a big effort of the firing pin 20 and the mainsprings 22 for carrying out a shot.

Before the shot, it is necessary to turn the safety-lock 11 with the segmented slot 12 upwards for disconnecting the barrel 4 from the gun carriage 1. To carry out a shot in the firearm with an electromechanical firing mechanism it is necessary to press the trigger 10, at the same time the trigger bar 9 will move the barrel 4 to the rear side, and the ledge of the sear 19 at the interaction with the rear wall 24 of the radial groove 23 will turn the sear 19 around the sear pin 18 and will release the cocked firing pin 20 with the pin handle 21, which, under the influence of the compressed mainspring 22, will move forward and the firing pin 20 will pierce the sealing rubber disk 29 and will contact with the rear part of the electric battery 27, that ensures the closure of the electrical circuit and the activation of the electric primer-igniter mounted in the cartridge case 13. The process of preparation and the process of the shot from the firearm with an electric primer-igniter do not differ from the shot with percussion primer-igniter described above.

The presented design of hand-held recoilless firearms can be used for underwater hunting and training of underwater shooting. To increase the efficiency of underwater hunting, this firearm can include two or more barrels 4 united by the gun carriage and by the firing control tool. For example, in a double-barreled firearm, the barrels 4 can be located in the gun carriage horizontally, and each barrel can have its trigger 10 with the trigger bar 9 and the common safety-lock 11, in which two segmented slots 12 are made on opposite sides for the possibility of disconnecting each barrel 4 from the gun carriage before the shot.

The weight of a single-barrel firearm is 1.8 kg, where the weight of the barrel with the breechblock is 1.1 kg and the ammunition weight is 0.1 kg. The weight of the aluminum gun carriage 1 with the pistol grip 2, the handle carrying 3 and with the tube with the outer diameter of 34 mm and the inner diameter of 30 mm is 0.6 kg. The weight of the single-barreled firearm in the water, taking into account the volume of the displaced water, is 1.3 kg. When this barrel is supplied with a float, providing lifting of the barrel to the water surface, this single-barreled firearm can have the weight in the water less than 0.2 kg before the shot.

The weight of the double-barreled firearm is 3.5 kg, taking into account the common pistol grip 2 and the handle carrying 3 for two barrels 4. The weight of the double-barreled firearm in the water, taking into account the volume of the displaced water, is 2.5 kg, which is quite acceptable for a double-barreled hunting gun of the 12th gauge. When each barrel is supplied with a float that provides lifting of the barrel weighing 1.1 kg to the water surface, the double-barreled firearm will have the weight about 0.3 kg in the water before shots.

It is possible to provide the firearm with "zero" buoyancy in the water before the shot and a positive buoyancy after the shot when using a foam plastic tube, which can be installed around of tube of the gun carriage 1, as done in the underwater revolver of Irwin R. Barr (see ARDASHEV A. N., FEDOSEEV S. L., "Oruzhie spetsial'noe, neobychnoe, exoticheskoe"—Moscow, "Voennaya technika" Publishers, 2001, pages 166-167, hereinafter referred as "ARDASHEV et al."). In this case, the gun carriage 1 will float on the water surface after the shot, and the underwater hunter does not need to care about the loss of the gun carriage 1 and can tow a large prey to the boat (surface watercraft) or to the shore.

If desired this recoilless firearm can be used for shooting from the air into the water when firing from a short air range (0.5-50 m), for example, from a boat. In this case, it is not necessary to install a sealing plastic cap 7 and a sealing rubber ring 8, but it is advisable to supply the barrel with float, which will provide lifting of the barrel to the water surface after the shot, because, depending on the shooting angle to the horizon the barrel may fall into the water away from the boat. The design of the underwater projectile shown in FIG. 1 has a stable flight in the air when firing from a smooth barrel 4 due to the aerodynamic stabilization of the cavitating core 16 by the aluminum sabot 17, which has an increased resistance in the air and separates only in the water. However, the technical dispersion of such a projectile in the air cannot provide a high probability of hitting the underwater target when firing into the water from a large air range.

For effective shooting from the air into the water from a large air range (50-200 m), for example, from a ship or a high bridge, it is advisable to use a rifling barrel with the barrel twist of 560-610 mm in this recoilless firearm. Making the projectile with angular velocity of rotation will ensure the separation of the sabot 17 into two sectors in the air and stable flight of the cavitating core 16 with small technical dispersion in the air and in the water. Besides, this firearm with a rifling barrel can be used for effective shooting in the air, for example, when hunting large animals. Moreover, this firearm with a rifling barrel can be used for shooting in an airless environment, for example, in weightlessness in the open space, because this recoilless firearm has no recoil and no impact on the shooter, both in the air and in the open space.

However, at underwater shooting the impact of a hydraulic shock wave on the shooter is possible. This hydraulic wave is created near the muzzle of the barrel at the expansion of the bubble of propellant (gunpowder) gas in the water at each shot. Therefore it is advisable to supply the muzzle part of the barrel 4 with a barrel-mounted device for a firearm in accordance with the Patent RU 2355967 C1 of 20 May 2009 or the U.S. Pat. No. 8,464,625 B2 on 18 Jun. 2013 or European Patent Specification No. 2224200 B1 of 23 Sep. 2015. This barrel-mounted device allows to reduce not only the recoil momentum that is absent in this recoilless firearm, but also makes it possible to reduce significantly the muzzle pressure of the powder gas and the hydraulic shock wave near the muzzle of the barrel 4 that will be useful in this recoilless firearm when shooting underwater. Moreover, the internal diameter of the tube of the gun carriage 1 is equal to 30 mm that allows it to accommodate a sufficiently effective barrel-mounted device for the barrel of 12th gauge, in which the muzzle of the barrel 4 will have gas vents and will be a part of this barrel-mounted device.

Increase in the accuracy and efficacy of shooting of recoilless firearm can be achieved by means of reducing the force of acting on the trigger and decreasing the time of the barrel displacing in the gun carriage for carrying out a shot.

Figure 4:
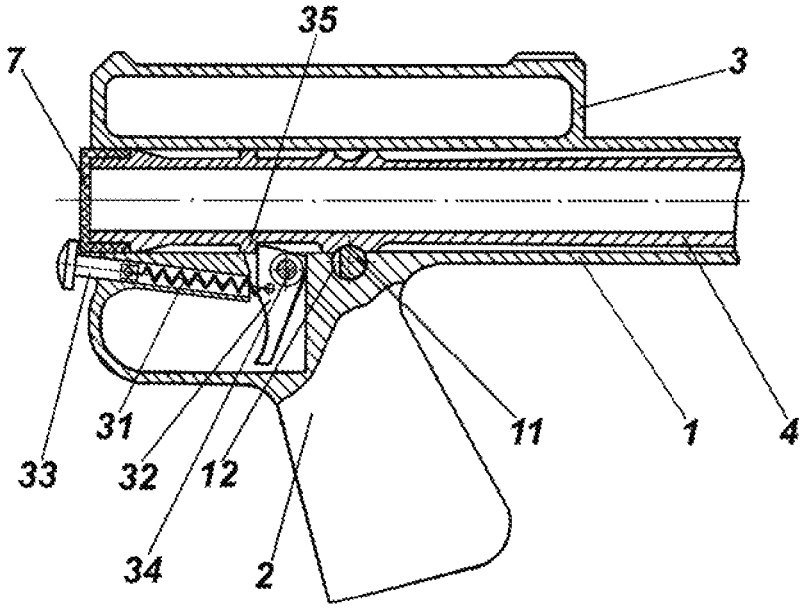
FIG. 4 shows the example of embodiment of the invention with a spring element of the drive in the fire control tool before a shot.

FIG. 4 shows a longitudinal cross-section of the muzzle part of the firearm before a shot, in which the firing control tool has a spring element of the drive providing movement of the barrel 4 in the gun carriage 1 for carrying out shot and includes a tension spring 31 connected with the trigger 32 and the pusher 33. The trigger 32 is fixed on the trigger pin 34 and contacts with the shoulder 35 of the ring groove of the barrel 4 and with the wall of the pistol grip 2, which excludes the rotation of the trigger 32 clockwise and keeps the barrel 4 from moving to the rear side. In this case, the head of the pusher 33 contacts with the edge of the face of the barrel 4, which is closed by a sealing plastic cap 7, keeps the barrel 4 from moving forward and at the same time tends to move the barrel 4 into the rear side from the force of action of the tension spring 31.

Before the shot it is necessary to turn the safety-lock 11 with the segmented slot 12 upwards for disconnecting the barrel 4 from the gun carriage 1. To carry out the shot it is necessary to press the trigger 32, which will turn around on the trigger pin 34 and cease to hold the shoulder 35 of the ring groove of the barrel 4, and the head of the pusher 33 will displace the barrel 4 to the rear side by compressing the tension spring 31. At the movement of the barrel 4 the firing mechanism will make a shot, as described above on FIG. 2 and FIG. 3.

When using recoilless firearm in small-sized underwater unmanned vehicle (UUV), for example, as suggested in the U.S. Pat. No. 7,814,696 B2 of 19 Oct. 2010 and U.S. Pat. No. 7,984,581 B2 of 26 Jul. 2011, a gun carriage with several barrels can be fixed to the turret of this vehicle with the possibility of remote aiming and is equipped with a laser sight and/or sonar guidance system.

The pistol grip 2 and the carrying handle 3 are not required in this firearm, wherein the remote fire control tool may include electro-hydraulic or electromechanical drive elements, as well as any other actuator elements (pneumatic, pyrotechnic, spring, etc.) providing movement of the barrel in the gun carriage for carrying out a shot, and the breechblock can be equipped with a percussion firing mechanism or an electromechanical (electrical) firing mechanism, depending on the type of the primer-igniter used in the ammunition.

Besides, it is advisable to equip each barrel with a float, which provides its lifting to the water surface after the shot, and to equip this float with a luminous element and a radio beacon to detect the barrel after the shot. Moreover, the float can be made inflatable according to the principle of an inflatable lifejacket, in which the filling mechanism will trigger from acceleration of the barrel movement during the shot; that will help to eliminate the inconvenience of maneuvering a small underwater vehicle with a lot of floats fixed on each barrel.

INDUSTRIAL APPLICABILITY

The present invention can be applied in the design of recoilless firearms for effective shooting with high-impulse ammunition at large underwater objects, including sharks, whales, tunas, etc., as well as for neutralizing sea mines by means of small-sized underwater vehicles.

Moreover, the present invention can be used in designs of recoilless firearms for shooting with high-impulse ammunition from the air into the water, in the air and in the airless environment, for example, in zero gravity in open space, since this recoilless firearm does not have any recoil and no effect on a shooter, both in the air and in the space.

The invention claimed is:

1. A recoilless underwater firearm comprising:

a gun carriage;

a fire control tool;

a barrel, which is reversibly connected to the gun carriage by the fire control tool and comprising at least a muzzle face at a front end of the barrel and a breechblock disposed at an opposite side of the muzzle face, a primer-igniter, a propellant charge, and a projectile, each of which are secured inside the barrel; and, wherein the barrel is disconnected from the gun carriage by the fire control tool before shooting the recoilless underwater firearm so that the barrel is disposed to be freely moveable within the gun carriage without impacting the gun carriage, and, wherein the fire control tool is connected to the barrel such that, after the barrel has been disconnected from the gun carriage, movement of the fire control tool displaces the barrel with respect to the gun carriage, and, wherein the breechblock is equipped with a firing mechanism which acts on the primer-igniter when the barrel is displaced in the gun carriage, and, wherein the barrel moves out of the gun carriage during the shot as a result of gas from the propellant charge impacting on the breechblock.

2. The recoilless underwater firearm in accordance with claim 1, wherein the primer-igniter, propellant charge and the projectile are united by a cartridge case and form unitary ammunition, wherein the primer-igniter is percussion type, and wherein the primer-igniter and the firing mechanism operate using percussion with respect to each other.

3. The recoilless underwater firearm in accordance with claim 1, wherein the primer-igniter, propellant charge and the projectile are united by a cartridge case and form unitary ammunition, wherein the primer-igniter is electric, and further wherein the firing mechanism of the breechblock is a sealed electrical or a sealed electromechanical firing mechanism.

4. The recoilless underwater firearm in accordance with claim 1, wherein the barrel is equipped with sealing elements installed in the muzzle face of the barrel and in the breechblock, which prevent the water from penetrating into the barrel until the projectile flies out of the barrel.

5. The recoilless underwater firearm in accordance with claim 1, wherein the barrel is equipped with a float fixed by a cord and intended to detect the barrel after the shot.

6. The recoilless underwater firearm in accordance with claim 5, wherein the float is equipped with a luminous and/or reflective element.

7. The recoilless underwater firearm in accordance with claim 1, wherein the barrel is equipped with an inflatable float, which provides lifting of the barrel to the water surface after the shot.

8. The recoilless underwater firearm in accordance with claim 7, wherein the float is equipped with a luminous and/or reflective element, and/or is equipped with a radio beacon.

9. The recoilless underwater firearm in accordance with claim 1, wherein the fire control tool includes a mechanical drive connected to the barrel which initiates displacement of the barrel with respect to the gun carriage for carrying out the shot.

10. The recoilless underwater firearm in accordance with claim 1, wherein the fire control tool includes a spring-loaded mechanical drive connected to the barrel which initiates displacement of the barrel with respect to the gun carriage for carrying out the shot.

11. The recoilless underwater firearm in accordance with claim 1, wherein the fire control tool is equipped with an electro-hydraulic or an electromechanical drive element connected to the barrel which initiates displacement of the barrel with respect to the gun carriage for carrying out the shot.

12. The recoilless underwater firearm in accordance with claim 1, wherein the fire control tool is equipped with a pneumatic or a pyrotechnic actuator element connected to the barrel which initiates displacement of the barrel with respect to the gun carriage for carrying out the shot.

* * * * *